US011920228B2

(12) United States Patent
Akisaka et al.

(10) Patent No.: US 11,920,228 B2
(45) **Date of Patent: *Mar. 5, 2024**

(54) COPPER ALLOY SHEET, COPPER ALLOY SHEET WITH PLATING FILM, AND METHOD FOR PRODUCING SAME

(71) Applicant: MITSUBISHI MATERIALS CORPORATION, Tokyo (JP)

(72) Inventors: Yoshiteru Akisaka, Aizuwakamatsu (JP); Naoki Miyashima, Aizuwakamatsu (JP); Kazunari Maki, Aizuwakamatsu (JP); Shinichi Funaki, Aizuwakamatsu (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/784,062

(22) PCT Filed: Dec. 8, 2020

(86) PCT No.: PCT/JP2020/045576

§ 371 (c)(1),
(2) Date: Jun. 9, 2022

(87) PCT Pub. No.: WO2021/117698

PCT Pub. Date: Jun. 17, 2021

(65) Prior Publication Data

US 2023/0047984 A1 Feb. 16, 2023

(30) Foreign Application Priority Data

Dec. 10, 2019 (JP) ..... 2019-222646

(51) Int. Cl.
*C22C 9/00* (2006.01)
*C22F 1/08* (2006.01)

(52) U.S. Cl.
CPC . *C22C 9/00* (2013.01); *C22F 1/08* (2013.01)

(58) Field of Classification Search
None
See application file for complete search history.

(56) References Cited

U.S. PATENT DOCUMENTS

2018/0040389 A1 2/2018 Matsunaga et al.
2021/0002743 A1 1/2021 Matsunaga et al.
2022/0081738 A1* 3/2022 Miyashima ..... C25D 5/10

FOREIGN PATENT DOCUMENTS

EP 3438298 A1 2/2019
EP 3438299 A1 2/2019
(Continued)

OTHER PUBLICATIONS

Machine translation JP 2014-027378A via Espacenet (translated Mar. 21, 2023) (Year: 2014).*
(Continued)

*Primary Examiner* — Elizabeth Collister
(74) *Attorney, Agent, or Firm* — Locke Lord LLP

(57) ABSTRACT

Providing a copper alloy plate, in which center Mg concentration at a center part in a plate thickness direction 0.1 mass % or more and less than 0.3 mass %, center P concentration is 0.001 mass % or more and 0.2 mass % or less, and the balance is composed of Cu and inevitable impurities; in which surface Mg concentration at a surface is 70% or less of the center Mg concentration; in which a surface layer part defined by a prescribed thickness from the surface has a concentration gradient of Mg of 0.05 mass %/μm or more and 5 mass %/μm or less increasing from surface toward center part of the plate thickness direction; and in which restraint of color change of the surface and increase of electrical contact resistance, and adhesiveness of a plating
(Continued)

film are excellent due to maximum Mg concentration in the surface layer part is 90% of the center Mg concentration.

8 Claims, 2 Drawing Sheets

(56) References Cited

FOREIGN PATENT DOCUMENTS

| | | | |
|---|---|---|---|
| JP | 2012007231 | A | 1/2012 |
| JP | 2014047378 | A | 3/2014 |
| JP | 2014095107 | A | 5/2014 |
| JP | 2016166397 | A | 9/2016 |
| JP | 2017101283 | A | 6/2017 |
| JP | 2019178398 | A | 10/2019 |
| JP | 2019178399 | A | 10/2019 |
| WO | 2019/189558 | A1 | 10/2019 |

OTHER PUBLICATIONS

International Search Report issued in PCT/JP2020/045576, dated Jan. 19, 2021.
Supplementary/Extended European Search Report (EESR) dated Dec. 7, 2023, issued for European Patent Application No. 20899732.0.

* cited by examiner

COPPER ALLOY SHEET, COPPER ALLOY SHEET WITH PLATING FILM, AND METHOD FOR PRODUCING SAME

BACKGROUND OF THE INVENTION

Technical Field

The present invention relates to a copper alloy sheet containing Mg and P, a copper alloy sheet with a plating film formed by plating on the copper alloy sheet, and a method for producing the same. Priority is claimed on Japanese Patent Application No. 2019-222646, filed Dec. 10, 2019, the content of which is incorporated herein by reference.

Background Art

For advances of reducing size, thickness and weight in an electronic device such as a cellular phone in recent years, terminals and connector parts used for them having a smaller size and a narrower pitch between electrodes are used. Moreover, reliability is also required under high temperature and strict conditions such as a vicinity of an engine of an automobile and the like. Accordingly, due to the necessity of the reliability of the electrical connection, further improvement is required for a strength, electrical conductivity, a spring deflection limit, stress relaxation characteristic, bending workability, fatigue resistance and the like: for that, copper sheets containing Mg and P shown in Patent Literatures 1 and 2 are used.

Patent Literature 1 disclose copper alloy for electrical/electronic devices containing Mg in a range of 0.15 mass % or more and 0.35 mass % or less, Pin a range of 0.0005 mass % or more and 0.01 mass % or less, and the balance Cu and inevitable impurities. This copper alloy is characterized in satisfying a relation of a mass ratio $[Mg]+20\times[P]<0.5$ between a content of Mg [Mg] and a content of P [P], and that the electric conductivity exceeds 75% IACS (international annealed copper standard).

The Mg—P type copper alloy "MSP1" the Applicant has developed is excellent in a strength, electrical conductivity, stress relaxation resistance and the like, and it is broadly used as a terminal for an automobile, a movable piece for a relay, a spring material for a contact, a bus bar module, a lithium ion battery, a terminal for a fuse, a miniature switch, a junction box, a relay box, a breaker, a terminal for a battery, and the like.

The Applicant has also proposed Patent Literature 2 to aim for further reduction of friction coefficient (reduction of the insertion force) of this copper alloy. Patent Literature 2 discloses an Sn-plating plate of Cu—Mg—P based copper alloy in which a base material is a copper alloy plate having a composition containing 0.2 to 1.2 mass % of Mg, 0.001 to 0.2 mass % of P, and the balance of Cu and inevitable impurities; the Sn-plating plate has a plating film layer after reflowing treatment in which an Sn phase having a thickness of 0.3 to 0.8 μm, an Sn—Cu alloy phase having a thickness of 0.3 to 0.8 μm, and a Cu phase having a thickness of zero to 0.3 μm are formed in order from a surface to the base material; a ratio (A/B) between an Mg concentration A of the Sn phase and an Mg concentration (B) of the base material is 0.005 to 0.05, and a ratio (C/B) of an Mg concentration (C) at an boundary surface layer of a thickness 0.2 to 0.6 μm between the plating film layer and the base material and the Mg concentration of the base material (B) is 0.1 to 0.3.

[Patent Literature 1] Japanese Unexamined Patent Application, First Publication No. 2017-101283

[Patent Literature 2] Japanese Unexamined Patent Application, First Publication No. 2014-047378

SUMMARY OF INVENTION

Technical Problem

Copper alloy containing Mg has a balance between an excellent mechanical strength and a good electrical conductivity by adding Mg. However, in the copper alloy containing Mg, in some using environment, there is a possibility over time of a change of color in the surface of the base material and an increase of contact electrical resistance.

The Sn-plating copper alloy plate disclosed in Patent Literature 2 is reduced in the friction coefficient on the surface of the Sn-plating layer by restraining the Mg concentration of the Sn phase on the surface of the plating film and the Mg concentration on the boundary surface layer between the plating film and the base material within a prescribed range in the Sn-plating copper alloy plate; but influences over time in the copper alloy base plate is not clear, and further improvement considering that point is desired.

The present invention is achieved in consideration of the above circumstances, and has an objection to restrain color change on the surface of the base material and increase of the contact electric resistance in the copper alloy plating containing Mg and to improve adhesiveness of the plating film.

Solution to Problem

Considering the above circumstances, Inventors has found as a result of earnest research that occurrence of color change of the surface of the base material, deterioration of the electrical contact resistance and deterioration of the adhesiveness of the plating film are caused by oxidization of Mg on the surface of the base material.

Since Mg is an active element, Mg on the surface of the copper alloy plate before plating immediately becomes oxide Mg. In order to improve the electrical connection reliability, the base material is plated; however, if plating a copper alloy plate in which an amount of Mg is large on a surface, oxide Mg on the surface of the base material and metal in the plating film cannot form metallic bond, to the adhesiveness of the plating film is deteriorated and peeling easily occurs when it is heated or the like.

Under such knowledge, the present invention provides a copper alloy plate having a good balance of the mechanical strength and the conductivity in which the oxidization on the surface can be restrained, and the color change and the contact electrical resistance on the surface of the base material is not deteriorated. When the plating film is formed, the adhesiveness is strived to be improved by reducing Mg concentration in the plating film.

In a copper alloy plate of the present invention, in a center part in a plate thickness direction, a center Mg concentration is 0.1 mass % or more and less than 0.3 mass %, a center P concentration is 0.001 mass % or more and 0.2 mass % or less, and the balance Cu and inevitable impurities; a surface Mg concentration on a surface is 70% or less of the center Mg concentration, and a surface layer part defined by a prescribed thickness from the surface has a concentration gradient of Mg concentration increasing from the surface toward the center part in the plate thickness direction at 0.05 mass %/μm or more and 5 mass %/μm or less, and Mg concentration in a deepest part is 90% of the center Mg concentration.

The surface Mg concentration is 70% or less of the center Mg concentration in this copper alloy plate, accordingly, the surface Mg concentration is less than 0.21 mass % in the present invention; oxide Mg is not easily generated on the surface, the electrical connection reliability is excellent, and it can be used as a contact as it is.

Moreover, even if the plating film is formed and subjected to heating treatment, it is possible to restrain Mg from diffusing into the plating film. Accordingly, the plating film can be prevented from peeling off. Furthermore, since the Mg concentration changes drastically in the surface layer part, the surface layer is thin and the excellent mechanical characteristic of copper alloy can be maintained.

In the surface layer part, if the concentration gradient of Mg from the surface is less than 0.05 mass %/μm, the characteristic of restraining the above-described Mg diffusion is saturated, on the other, the Mg concentration cannot be prescribed until a considerable depth; the characteristic of the copper alloy plate containing Mg is spoiled. If the concentration gradient of Mg exceeds 5 mass %/μm, the surface layer part in which the Mg concentration is low comparing with the center part in the plate thickness direction is too thin, the effect of restraining the diffusion of Mg is poor.

In one aspect of this copper alloy plate, the thickness of the surface layer part is 5 μm or less. If the thickness of the surface layer part exceeds 5 μm, a ratio occupied by an area where an Mg content is small is large in a whole plate thickness, so that the mechanical characteristic as copper alloy containing Mg may be spoiled. This deterioration of the characteristic is especially remarkable when the plate thickness is small.

A copper alloy plate with a plating film of the present invention has the copper alloy plate and a plating film formed on the surface layer part.

This copper alloy plate with a plating film is excellent in the adhesiveness of the plating film since an amount of oxide Mg is small since the Mg concentration at the surface of the copper alloy plate is low; and also, it is possible to reduce Mg diffusing into the plating film from the copper alloy plate.

In one aspect of this copper alloy plate with a plating film, an average Mg concentration in the plating film is 10% or less of the center Mg concentration of the copper alloy plate.

If the average Mg concentration in the plating film exceeds 10% of the center Mg concentration of the copper alloy plate, an effect of the surface diffusion Mg on the electrical contact resistance becomes large.

In another aspect of this copper alloy plate with a plating film, the plating film is configured from one or more layers selected from tin, copper, zinc, nickel, gold, silver, palladium, and alloy of two or more of them. Forming the plating film of these metal or alloy, it can be appropriately used for a connector terminal.

A method of producing a copper alloy plate according to the present invention has Mg concentration treatment forming a surface part where Mg is concentrated by diffusing Mg in Mg-containing copper alloy plate toward the surface to gather and concentrate, and surface part removal treatment forming the surface layer part by removing the surface part where Mg is concentrated.

In this producing method, Mg in the copper alloy containing Mg is first diffused to the surface part to concentrate, and then the surface part which is concentrated is removed. Since the Mg concentration in the surface layer part formed by removing the surface part is low and an oxide film is less generated on the surface, the color change of the surface and the increase of the electrical contact resistance is restrained and the adhesiveness of the plating film is excellent.

Advantageous Effects of Invention

According to the present invention, oxidization and color change of a surface of a copper alloy plate is restrained, electrical connection reliability is improved, Mg concentration in a plating film is reduced when the plating film is formed, and adhesiveness of the plating film can be improved.

DESCRIPTION OF EMBODIMENTS

Figure 1:
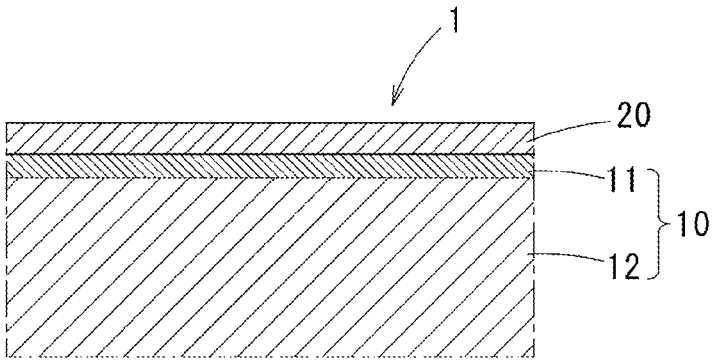
FIG. 1 It is a cross-sectional view schematically showing one embodiment of a copper alloy plate with a plating film of the present invention.

One embodiment of the present invention will be explained. A copper alloy plate 1 with a plating film has a copper alloy plate 10 containing Mg and P, and a plating film 20 formed on the surface of it, as shown in FIG. 1.

[Copper Alloy Plate]

The copper alloy plate 10 contains 0.1 mass % or more and less than 0.3 mass % of Mg and 0.001% or more and 0.2% or less of P, and the balance is made of Cu and inevitable impurities, in a center portion of a plate thickness direction.

(Mg, P)

Mg is formed into a solid solution within a base of Cu to improve strength without deteriorating electrical conductivity. P has a deoxidizing action at the time of melting and casting, and improves the strength in a state of being coexistent with the Mg component. Mg and P can exhibit the characteristics effectively by being contained in the copper alloy at the above ranges.

Mg concentration (surface Mg concentration) on the surface of the copper alloy plate 10 is 70% or less, preferably 60% or less, more preferably 50% or less (0% or more) of Mg concentration (center Mg concentration) of the center part of the plate thickness. Mg concentration is increased from the surface toward the center of the plate thickness of the copper alloy plate 10 at 0.05 mass %/μm or more and 5 mass %/μm or less of a concentration gradient.

On the surface of the copper alloy plate 10, oxidized Mg is not easily generated since the surface Mg concentration is 70% or less of the center Mg concentration. Accordingly, color change on the surface of the base material and increase of contact electrical resistance is restrained and the plating film 20 can be prevented from peeling off.

If Mg is not contained in the surface (the surface Mg concentration is 0% of the center Mg concentration), it is possible to prevent the surface oxidization and to restrain the diffusion of Mg to the plating film 20. However, if the surface Mg concentration is 70% or to less of the center Mg concentration, it is preferable because the characteristic as copper alloy containing Mg can be added even on the surface. More preferable surface Mg concentration is 60% or less to the center Mg concentration, further more preferably, 50% or less.

If the concentration gradient of Mg increasing from the surface in the thickness direction is less than 0.05 mass %/μm, desired Mg concentration cannot come up to a considerably depth, so that the characteristic as the copper alloy plate containing Mg cannot easily be obtained. On the other, if the concentration gradient of Mg exceeds 5 mass %/μm, the effect of restraining diffusion of Mg to the plating film is poor. The concentration gradient is preferably 4 mass %/μm or less, more preferably 3 mass %/μm or less, even more preferably, 2 mass %/μm or less.

In a part where the concentration gradient occurs, a region from the surface where the Mg concentration is 90% or less of the center Mg concentration is a surface layer part 11. The surface layer part 11 has a thickness of 5 μm or less, preferably 3 μm or less, more preferably 2 μm or less. A part inside the surface layer part 11 is defined as a base material inside 12 with respect to the surface layer part 11.

In other words, the surface layer part 11 having a thickness of 5 μm or less (preferably 3 μm or less, more preferably 2 μm or less) is set from the surface of the copper alloy plate 10. The Mg concentration in the surface layer part 11 increases at a gradient of 0.05 mass %/μm or more and 5 mass %/μm or less from the surface toward the center portion; it is 70% or less (preferably 60% or less, more preferably 50% or less) of the center Mg concentration on the surface, and is the maximum in the deepest portion, 90% of the center Mg concentration.

Figure 3:
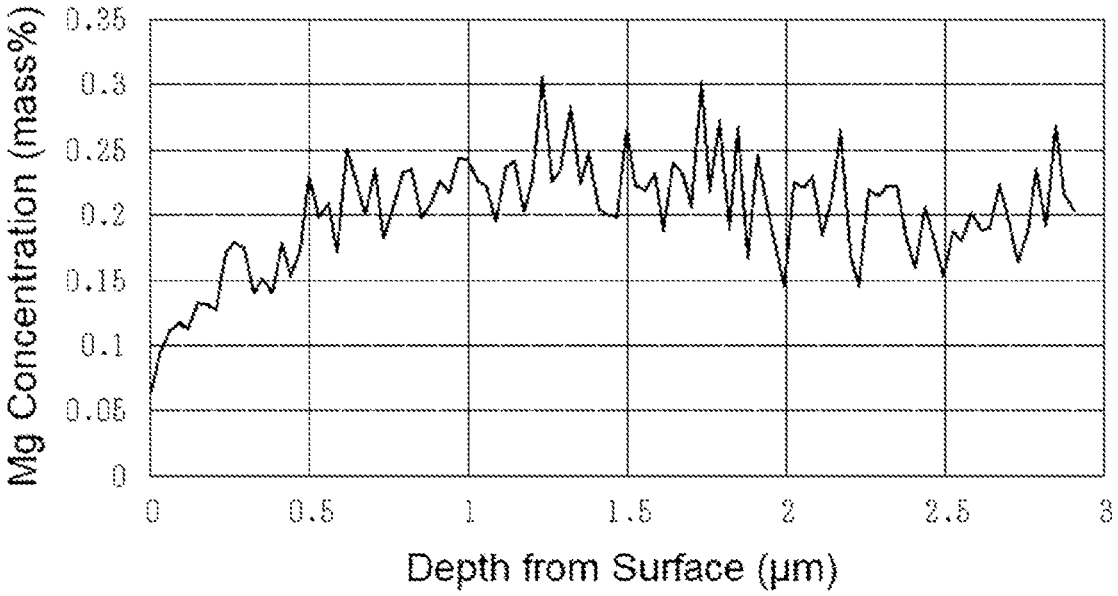
FIG. 3 It is an analysis diagram of an Mg component in a depth direction of a copper alloy plate measured by a transmission electron microscope and an EDX analysis device (TEM-EDX).

FIG. 3 is a graph showing a result of analyzing the Mg component using a transmission electron microscope and an EDX analysis device (TEM-EDX) in the depth direction in a sample obtained by film thinning the copper alloy plate 10 in the thickness direction. In this graph, the horizontal axis is the depth (distance) from the surface, and the vertical axis is the Mg concentration (mass %). In the copper alloy plate 10 having the Mg concentration gradient in the depth direction, an arithmetic average of the maximum value and the minimum value of the center portion in the thickness direction where the Mg concentration is stable is defined as the center Mg concentration, and a depth to the position where it first comes up to 90% of the center Mg concentration is defined as the thickness of the surface layer part 11.

(Component Other than Mg and P)

The copper alloy plate 10 may contain 0.0002 to 0.0013 mass % of carbon and 0.0002 to 0.001 mass % of oxygen in addition.

Carbon is an element which extremely cannot enter to pure copper, however, if a very small quantity is contained, it has a function of prevent oxide containing Mg from largely growing. However, the effect is not sufficient if content of the carbon is less than 0.0002 mass %. On the other, if the content of the carbon exceeds 0.0013 mass %, it exceeds solid solution limit and precipitates on crystal boundaries to occur intergranular cracking, so that it is not preferably since it is made brittle and cracking may occur while bending work on the alloy plate. The more preferable range of carbon content is 0.0003 to 0.0010 mass %.

Oxygen makes oxide with Mg. if the Mg oxide is fine and the quantity is small, it is effective to reduce wearing of a die for punching out the copper alloy plate. However, the effect is not sufficient if the content of oxygen is less than 0.0002 mass %; and on the other, if it exceeds 0.001 mass %, it is not preferable since the oxide including Mg grows large. More preferable range of content of oxygen is 0.0003 to 0.0008 mass %.

Moreover, the copper alloy plate may contain 0.001 to 0.03 mass % of Zr. Zr contributes to improvement of tensile strength and spring limit value if added with a range of 0.001 to 0.03 mass %; however, the effect cannot be expected if the addition amount is out of the range.

[Plating Film]

The plating film 20 is a plating film made of Sn or Sn alloy in this embodiment, and has a thickness of 0.1 μm to 10 μm for example.

An average Mg concentration in the plating film 20 is 10% or less (0% or more) of the center Mg concentration of the copper alloy plate 10 measured after heating at 150° C. for 120 hours.

If the average Mg concentration in Plating film 20 exceeds 10% of the center Mg concentration of the copper alloy plate 10, there are cases of deteriorating the adhesiveness of the plating film and increase of the contact electrical resistance due to diffusion of Mg from the copper alloy plate 10 to the plating film 20. The average Mg concentration in the plating film 20 is more preferably 5% or less of the center Mg concentration of the copper alloy plate 10, even more preferably, 3% or less.

[Producing Method]

A method of producing the copper alloy plate 10 and the copper alloy plate 1 with a plating film configured as above will be explained.

The copper alloy plate 10 is produced by producing a copper alloy base material having a component composition containing 0.1 mass % or more and less than 0.3 mass % of Mg, 0.001 to 0.2 mass % of P, and the balance of Cu and inevitable impurities (a producing step of copper alloy base material) and performing surface treatment on the obtained copper alloy base material. The copper alloy plate 1 with a plating film is produced by forming a plating film 20 on the surface of the copper alloy plate 10 by performing electroplating at 0.1 A/dm$^2$ or more and 60 A/dm$^2$ or less.

(Producing Step of Copper Alloy Base Material)

The copper alloy base material is produced by making a copper alloy ingot by melting and casting material which is formulated in the above component range and performing a process including hot rolling, cold rolling, continuous annealing, and finish-cold rolling in this order on this copper alloy ingot. In the present embodiment, a thickness of the copper alloy base material is 0.8 mm (Surface Treatment Step)

Surface treatment is performed on the obtained copper alloy baes material. This surface treatment has an Mg concentration treatment forming a surface part where Mg in the copper alloy base material is concentrated by diffusing and gathering in the surface part, and surface part removal treatment removing the surface part where Mg is concentrated.

For the Mg concentration treatment, the copper alloy base material is heated in oxidizing atmosphere such as ozone or the like at a prescribed temperature for a prescribed time. In this case, it may be carried out for a time in which recrystallization does not occur at 100° C. or more, arbitrary temperature considering an equipment restriction, economy, and the like. For example, 300° C. for one minute, 250° C. for two hours, or 200° C. for five hours; a long time is for low temperature, and a short time is for high temperature.

Concentration of oxidative substance in the oxidizing atmosphere is 5 to 4000 ppm for ozone for example, desirably 10 to 2000 ppm, more desirably 20 to 1000 ppm.

In a case in which ozone is not used but oxygen is used, atmosphere concentration is desirably two times or more in the case in which only ozone is used. Oxidative substance such as ozone or the like and oxygen may be mixed to use. In addition, treatment such as introduction of distortion or pores by mechanical polishing to accelerate diffusion of Mg may be carried out before the Mg concentration treatment.

For the surface part removal treatment, one or combination of chemical polishing, electrolytic polishing, or mechanical polishing can be applied on the copper alloy base material on which the Mg concentration treatment is carried out. Selective etching and the like can be used for the chemical polishing. The selective etching can be used, for example, by etching using an acidic or alkaline liquid containing a component capable of suppressing copper corrosion such as a nonionic surfactant, a heterocyclic compound having a carbonyl group or a carboxyl group, an imidazole compound, a triazole compound, and a tetrazole compound.

For the electrolytic polishing, preferential etching on the crystal grain boundaries by electrolytic on component which can be easily segregated on the copper crystal grain boundaries using acid or alkaline liquid as electrolytic liquid can be used. For example, polishing can be carried out by electrically energizing in phosphoric acid aqueous using SUS304 as a counter electrode. For the mechanical polishing, various methods which are generally used can be used, such as blasting, lapping, polishing, buffing, grinder polishing, sand-paper polishing, or the like.

As above, the copper alloy plate 10 is formed by performing the Mg concentration treatment and the surface part removal treatment on the copper alloy plate base material. As described above, in the copper alloy plate 10, the Mg concentration of the surface layer part 11 is lower in comparison with the center Mg concentration, and the Mg concentration increases from the surface toward the center of the plate thickness direction at a prescribed concentration gradient.

(Plating Treatment Step)

Next, the plating film 20 may be formed by plating treatment on the surface of the copper alloy plate 10. For example, after cleansing the surface by performing such as degreasing, pickling, and the like on the surface of the copper alloy plate 10, then performing Sn plating made of Sn or Sn alloy, the plating film 20 made of Sn or Sn alloy is formed on the surface of the copper alloy plate 10.

The plating film 20 is formed by electroplating with 0.1 $A/dm^2$ or more and 60 $A/dm^2$ or less of current density. If the current density is less than 0.1 $A/dm^2$ while the electroplating, it is not economic since the film formation rate is slow. If the current density exceeds 60 $A/dm^2$, it exceeds diffusion-limited current density, and there is a case that the film without defects cannot be formed.

An instance of a condition for the Sn plating made of Sn or Sn alloy is followings.

Treatment method: Electroplating

Plating solution: Tin sulfate plating solution

Solution temperature: 20° C.

Current density: 2 $A/dm^2$

Since an amount of Mg is extremely small on the surface of the copper alloy plate 10, surface oxide is also few, and if the oxide is slightly present, it can be easily removed by normal cleansing and the like before plating. Accordingly, the copper alloy plate 1 with a plating film is excellent in the adhesiveness between the plating film 20 and the copper alloy plate 10. Moreover, since oxide Mg is hardly generated on the surface, an increase in contact electric resistance can be suppressed.

While the plating film 20 mad of Sn or Sn alloy was formed on the surface of the copper alloy plate 10 by Sn plating made of Sn or Sn alloy in the present embodiment, the plating film is not limited to this: it may be configured by one or more layers selected from tin, copper, zinc, nickel, gold, silver, palladium, and alloys of two or more of them. The plating film may be made of a plurality of these layers.

The plating film may have a structure in which a part or whole of it is alloyed with the base metal if it is formed by the plating step.

Figure 2:
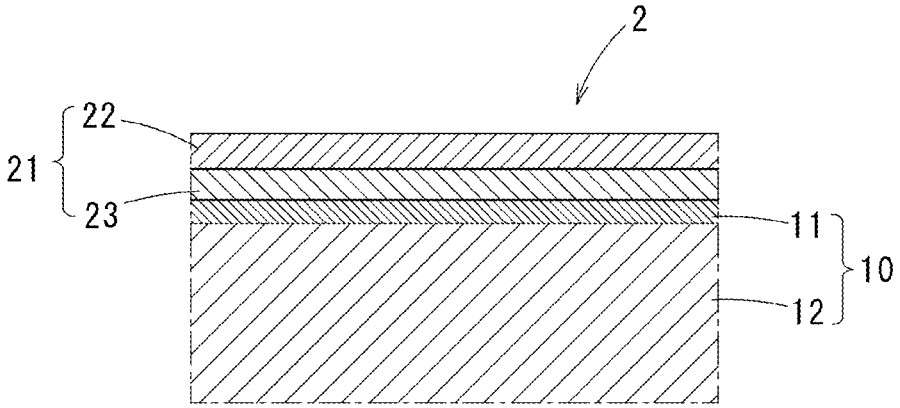
FIG. 2 It is a cross-sectional view schematically showing another embodiment of the copper alloy plate with a plating film of the present invention.

FIG. 2 shows a copper alloy plate 2 with a plating film of another embodiment. The copper alloy plate 10 is the same one as in the embodiment shown in FIG. 1. In the copper alloy plate 2 with a plating film shown in FIG. 2, a plating film 21 is configured from a plating layer 22 having a thickness of 0 μm to 10 μm and an alloy layer 23 of metal of this plating layer 22 and Cu of the copper alloy plate 10 in this order from the surface to the copper alloy plate 10.

The alloy layer 23 is possibly formed by time or heat treatment (dehydrogenation, drying, and the like), but there is a case of not being formed immediately after plating (the thickness is 0 μm); so, the existence of the alloy layer does not limit aspects of the invention. In a case in which the alloy layer 23 is formed, there is a case in which all metal in the plating layer is alloyed with Cu to become the alloy layer 23 and the plating layer does not exist (the thickness is 0 μm).

That is, at least either layer of the plating layer 22 and the alloy layer 23 exists. As such a plating film 21, for example, an Sn layer made of Sn or Sn alloy is applied for the plating layer 22 and a Cu—Sn alloy layer is applied for the alloy layer 23.

In addition, the plating layer 22 may be configured from a plurality of layers. For example, it is a case in which an Ag layer is formed by performing silver plating made of silver or silver alloy on an Sn layer.

Example 1

An ingot of copper alloy containing 0.1 mass % or more and less than 0.3 mass % of Mg and 0.001 mass % or more and 0.2 mass % or less of P and the balance of Cu and inevitable impurities was prepared and subjected to hot rolling, intermediate annealing, cold rolling and the like by general methods to produce a copper alloy base material having a plate shape. Component composition contains, for example, 0.22 mass % of Mg and 0.0019 mass % of P, and the balance Cu and inevitable impurities.

Next, to this copper alloy base material, subjecting the Mg concentration treatment heating under oxidization atmosphere at 250° C. for two hours, then carrying out the surface part removal treatment, the copper alloy plate was produced.

For the surface part removal treatment, chemical polishing was carried out by dipping in polishing solution in which poly oxyethylene dodecyl ether was added to mixed aqueous solution of sulfuric acid and hydrogen peroxide.

As Comparative Examples, samples (samples 1 and 4) in which the Mg concentration treatment and the surface part removal treatment on the copper alloy base material were not performed were produced.

Mg concentration was measured on the surface and in each part of the thickness direction of the copper alloy plate (base material).

The Mg concentration in the thickness direction was measured from a concentration profile in a depth direction in the transmission electron microscope and the EDX analysis device (TEM-EDX: energy dispersion type X-ray spectroscopy system). Measurement conditions of TEM-EDX are as follows.

(Measurement Condition)

Measurement sample preparation method: FIB (Focused Ion Beam) method

Measurement sample preparation device: Focused ion beam device (SMI3050 TB made by old SII Nano Technology Co. Ltd.)

Observation and analysis device: Transmission electron microscope (Titan G2 80-200: TEM made by FEI) and EDX device (Super-X energy dispersion X-ray analysis system made by FEI)

EDS (energy dispersion X-ray analysis) condition: a line profile is extracted from Eds-map Acceleration voltage: 200 kV Magnification: 200000 times Evaluation results of Samples are shown in Tables 1 and 2. In Tables 1 and 2, the center Mg concentration is an Mg concentration at the center portion in the plate thickness, a surface layer part thickness is a thickness from the surface until the Mg concentration of the copper alloy plate first reaches 90% of the plate thickness center concentration, and the concentration gradient is a gradient of Mg concentration in the surface layer part.

The surface layer part thickness and the Mg concentration gradient are calculated from a concentration profile in a depth direction of Mg component by TEM-EDS. For an instance, FIG. 3 shows a profile regarding Sample 8 (the center Mg concentration is 0.22 mass %, the concentration gradient is 0.27 mass %/μm, an Mg concentration ratio of surface/center is 30%) shown in Table 1.

The Mg concentration gradient means a gradient linearly connecting a concentration in the profile at the surface and a point where it first reaches 90% of the center Mg concentration. That is, in the depth direction concentration profile, if a change of the Mg concentration from the surface to the point where it first reaches 90% of the center Mg concentration can be regarded as a line having substantially a constant incline even if there is a locally fluctuation, the incline is the concentration gradient.

The contact electrical resistance was measured following JIS-C-5402 on samples in which the copper alloy plate (base material) was heated at 150° C. for 120 hours by a four-terminal contact electrical resistance tester (CRS-113-AU made by Yamasaki Seiki Laboratory) with continuously changing a load from 0 g to 50 g in a sliding method (1 mm), and it was evaluated by the contact electrical resistance value when the load was 50 g. It was evaluated "A" if the contact electrical resistance was less than 2 mΩ, "B" if it was 2 mΩ or more and less than 5 mΩ, and "C" if it was 5 mΩ or more.

Regarding surface hardness, hardness of samples was measured using the Bickers hardness meter at the loads 0.5 gf and 10 gf. It was evaluated "A" if the hardness measured at the load 0.5 gf was 90% or more of the hardness measured at the load 10 gf, "B" if it was 80% or more and less than 90%, and "C" if it was less than 80%.

Regarding discoloration, Samples were exposed in a constant-temperature and constant-humidity tank of an environment of 50° C., RH 95% for five days, the colors are compared before and after the exposure, and it was evaluated by a color difference $\Delta E^*_{ab}$ in the L*a*b* color system based on C1020 as a standard. The color difference is $\Delta E^*_{ab}=[(\Delta L^*)^2+(\Delta a^*)^2+(\Delta b^*)^2]^{1/2}$. It was evaluated "A" if the $\Delta E^*_{ab}$ was zero or more and less than 20, and "B" if it was 20 or more.

TABLE 1

| | No. | Center Mg Concentration (wt %) | Concentration Gradation (wt %/μm) | Surface Mg Concentration (wt %) | Surface/Center Mg Concentration Ratio (%) | Thickness of Surface Layer Part (μm) | Contact Electrical Resistance | Surface Hardness | Discoloration |
|---|---|---|---|---|---|---|---|---|---|
| Examples | 1 | 0.10 | 0.06 | 0.061 | 61% | 0.48 | A | A | A |
| | 2 | | 0.25 | 0.024 | 24% | 0.26 | A | A | A |
| | 3 | | 1.90 | 0.038 | 38% | 0.03 | A | A | A |
| | 4 | | 3.60 | 0.059 | 59% | 0.01 | B | A | A |
| | 5 | | 3.60 | 0.012 | 12% | 0.02 | B | A | A |
| | 6 | | 4.90 | 0.033 | 33% | 0.01 | B | A | A |
| | 7 | 0.22 | 0.08 | 0.152 | 69% | 0.58 | A | A | A |
| | 8 | | 0.27 | 0.066 | 30% | 0.49 | A | A | A |
| | 9 | | 2.10 | 0.149 | 68% | 0.02 | B | A | A |
| | 10 | | 2.50 | 0.138 | 63% | 0.02 | B | A | A |
| | 11 | | 4.20 | 0.110 | 50% | 0.02 | B | A | A |
| | 12 | | 4.80 | 0.151 | 69% | 0.01 | B | A | A |
| | 13 | 0.29 | 0.05 | 0.060 | 21% | 4.02 | A | A | A |
| | 14 | | 0.27 | 0.135 | 47% | 0.47 | A | A | A |
| | 15 | | 2.60 | 0.139 | 48% | 0.05 | A | A | A |
| | 16 | | 2.60 | 0.199 | 69% | 0.02 | B | A | A |
| | 17 | | 4.50 | 0.148 | 51% | 0.03 | A | A | A |
| | 18 | | 4.50 | 0.200 | 69% | 0.01 | B | A | A |

TABLE 2

| | No. | Center Mg Concentration (wt %) | Concentration Gradiation (wt %/μm) | Surface Mg Concentration (wt %) | Surface/Center Mg Concentration Ratio (%) | Thickness of Surface Layer Part (μm) | Contact Electrical Resistance | Surface Hardness | Discoloration |
|---|---|---|---|---|---|---|---|---|---|
| Comparative Examples | 1 | 0.10 | ∞ (untreated) | 0.1 | 100 | — | C | A | B |
| | 2 | | 0.01 | 0 | 0 | 9.0 | A | C | A |
| | 3 | | 10 | 0 | 0 | 0.01 | C | A | B |

TABLE 2-continued

| No. | Center Mg Concentration (wt %) | Concentration Gradiation (wt %/μm) | Surface Mg Concentration (wt %) | Surface/Center Mg Concentration Ratio (%) | Thickness of Surface Layer Part (μm) | Contact Electrical Resistance | Surface Hardness | Discoloration |
|---|---|---|---|---|---|---|---|---|
| 4 | 0.29 | ∞ (untreated) | 0.29 | 100 | — | C | A | B |
| 5 | | 0.01 | 0 | 0 | 26.1 | A | C | A |
| 6 | | 10 | 0 | 0 | 0.03 | C | A | B |

As shown in Tables 1 and 2, comparing with the copper alloy plate (Samples 1 to 18 in Table 1) on which the Mg concentration treatment and the surface part removal treatment were carried, the copper alloy samples (Samples 1 and 4 in Table 2) on which the Mg concentration treatment and the surface part removal treatment were not carried and the copper alloy plate (Samples 3 and 6 in Table 2) in which the Mg concentration gradient exceeds 5 mass %/μm were poor in the contact electrical resistance, and the discoloration also occurred on the surface part. The copper alloy plate (Samples 2 and 5 in Table 2) in which the Mg concentration gradient was less than 0.05 mass %/μm was remarkably low in the surface hardness.

Example 2

By the same method as in Example 1, a copper alloy plate (Samples 21 to 27 in Table 3) with the lower-limit Mg concentration gradient (0.05 mass %/μm) in the surface layer part, a copper alloy plate (Samples 28 to 36 in Table 3) with the upper-limit Mg concentration gradient (5 mass %/μm) in the surface layer part, and a copper alloy plate (Samples 28 to 34 in Table 4) with the Mg concentration gradient (10 mass %/μm) that is above the upper limit were produced, where the center Mg concentration (equal to the Mg concentration of the base material) was 0.22 mass %.

The surface Mg concentration of the copper alloy plates was 0 mass %. However, in order to confirm a case in which Mg exists on the surface, the copper alloy plates in which the surface layer part thickness was slightly small were prepared (Samples 35 and 36 in Table 3).

In addition, regarding Comparative Examples shown in Table 4, Samples 21 to 27 were not subjected to the Mg concentration treatment and the surface part removal treatment; accordingly, the Mg concentration gradient is not generated.

These copper alloy plates (or the base material) were treated to form only one layer of each metal plating to form samples of the copper alloy plate with a plating film. The metal types of the plating were Sn, Cu, Zn, Ni, Au, Ag, and Pd. The plating current density was 3 A/dm$^2$ for all to form the plating film with a thickness of 1 μm. For the plating baths, any of acidic solution, neutral solution, and alkaline bath which are generally used can be used. In the present Examples, the plating treatment was carried out using the acidic solution for Sn, Cu, Zn, Ni, and Pd, and using the alkaline bath for Au and Ag.

Regarding the samples produced by the above process, the electrical contact resistance and the adhesiveness of the plating film and the average Mg concentration in the plating film were evaluated.

The electrical contact resistance was evaluated using the samples immediately after plating by the same measuring method and the judging method as in Example 1.

The adhesiveness was evaluated on the samples after heating at 150° C. for 120 hours by the cross-cut test. 100 squares of 1 mm square were made by scratching the samples by a cutter knife, and adhesive tape (cellophane tape #405 made by Nichiban Co., Ltd.) was pressed on the squares by fingers; it was evaluated "A" if the plating film was not peeled, "B" if the peelings were three or less of the squares, and "C" if four or more of the squares were peeled off.

The Mg average concentration in the plating film was measured on the samples of the copper alloy plate with a plating film (or the base material with a plating film) heated at 150° C. for 120 hours by the same method as in Example 1 by XPS. The evaluation results are shown in Tables 3 and 4.

TABLE 3

| | No. | Center Mg Concentration (wt %) | Surface Layer Part Thickness (μm) | Concentration Gradient (wt %/μm) | Plating Metal | Average Mg Concentration (wt %) | Adhesiveness | Electrical Contact Resistance |
|---|---|---|---|---|---|---|---|---|
| Examples | 21 | 0.22 | 3.96 | 0.05 | Sn | 0.007 | A | A |
| | 22 | | | | Cu | 0.005 | A | A |
| | 23 | | | | Zn | 0.012 | A | A |
| | 24 | | | | Ni | 0.001 | A | A |
| | 25 | | | | Au | 0.014 | A | A |
| | 26 | | | | Ag | 0.017 | A | A |
| | 27 | | | | Pd | 0.003 | A | A |
| | 28 | | 0.04 | 5 | Sn | 0.019 | A | A |
| | 29 | | | | Cu | 0.005 | A | A |
| | 30 | | | | Zn | 0.007 | A | A |
| | 31 | | | | Ni | 0.001 | A | A |
| | 32 | | | | Au | 0.005 | A | A |
| | 33 | | | | Ag | 0.021 | A | A |
| | 34 | | | | Pd | 0.005 | A | A |
| | 35 | | 0.035 | | Sn | 0.024 | A | B |
| | 36 | | 0.024 | | Sn | 0.075 | A | B |

TABLE 4

| | No. | Center Mg Concentration (wt %) | Surface Layer Part Thickness (μm) | Concentration Gradient (wt %/μm) | Plating Metal | Average Mg Concentration (wt %) | Adhesiveness | Electrical Contact Resistance |
|---|---|---|---|---|---|---|---|---|
| Comparative Examples | 21 | 0.22 | — | ∞ (untreated) | Sn | 0.014 | C | C |
| | 22 | | | | Cu | 0.017 | C | C |
| | 23 | | | | Zn | 0.038 | C | C |
| | 24 | | | | Ni | 0.059 | C | C |
| | 25 | | | | Au | 0.018 | C | C |
| | 26 | | | | Ag | 0.056 | C | C |
| | 27 | | | | Pd | 0.023 | C | C |
| | 28 | | 0.02 | 10 | Sn | 0.026 | C | C |
| | 29 | | | | Cu | 0.027 | C | C |
| | 30 | | | | Zn | 0.017 | C | C |
| | 31 | | | | Ni | 0.020 | C | C |
| | 32 | | | | Au | 0.005 | C | C |
| | 33 | | | | Ag | 0.030 | C | C |
| | 34 | | | | Pd | 0.025 | C | C |

In the Examples in Table 3, all Samples 21 to 34 have 0 mass % of the surface Mg concentration. In Examples 35 and 36 in which the surface layer part thickness is small, Mg exists on the surface.

As shown in Table 3, in the copper alloy plate with a plating film in which the surface Mg concentration was 0 mass %, the adhesiveness and the electrical contact resistance of the plating film were good, and the Mg average concentration in the plating film was 10% or less of the center Mg concentration.

However, in Examples 35 and 36 in which Mg exists on the surface of the copper alloy plate, the electrical contact resistance was large comparing with the other Examples, and the Mg average concentration in the plating film was a value exceeding 10% of the center Mg concentration.

As shown in Table 4, in Comparative Examples 28 to 34 in which the Mg concentration gradient exceeds 5 mass %/μm, the electrical contact resistance was remarkably large and the plating was peeled off after heating. Moreover, in many of them, the average Mg concentration in the plating film exceeded 10% of the center Mg concentration.

In addition, although plating was only one layer in Example 2, the embodiment is not limited to this; it is possible to alloy various metals by treatment such as heating and to make multi-layer plating structure and the like, in order to reduce costs and to further improve and the like.

INDUSTRIAL APPLICABILITY

In the copper alloy plate containing Mg, it is possible to restrain the color change of the surface of the base material and the increase of the electrical contact resistance, and to improve the adhesiveness of the plating film.

REFERENCE SIGNS LIST

1, 2 Copper alloy plate with plating film
10 Copper alloy plate
11 Surface layer part
12 Base material inside
20, 21 Plating film
22 Plating layer
23 Alloy layer

The invention claimed is:

1. A copper alloy plate, wherein in a center part in a plate thickness direction, a center Mg concentration is 0.1 mass % or more and less than 0.3 mass %, a center P concentration is 0.001 mass % or more and 0.2 mass % or less, and the balance Cu and inevitable impurities, a surface Mg concentration on a surface is 70% or less of the center Mg concentration, and a surface layer part defined by a prescribed thickness from the surface has a concentration gradient of Mg concentration increasing from the surface toward the center part in the plate thickness direction at 0.05 mass %/μm or more and 5 mass %/μm or less, and Mg concentration in a deepest part is 90% of the center Mg concentration.

2. The copper alloy plate according to claim 1 wherein the thickness of the surface layer part is 5 μm or less.

3. A copper alloy plate with a plating film having the copper alloy plate described in claim 1 and a plating film formed on the surface layer part.

4. The copper alloy plate with a plating film according to claim 3, wherein an average Mg concentration in the plating film is 10% or less of the center Mg concentration.

5. The copper alloy plate with a plating film according to claim 3, wherein the plating film is configured from one or more layers selected from tin, copper, zinc, nickel, gold, silver, palladium, and alloy of two or more of them.

6. The copper alloy plate with a plating film according to claim 3, wherein the thickness of the surface layer part is 5 μm or less.

7. A method of producing a copper alloy plate according to claim 1, comprising Mg concentration treatment for a copper alloy plate material wherein Mg concentration is 0.1 mass % or more and less than 0.3 mass %, P concentration is 0.001 mass % or more and 0.2 mass % or less, and the balance is composed of Cu and inevitable impurities, forming a surface part where Mg is concentrated by diffusing Mg to a surface, and surface part removal treatment forming the surface layer part by removing the surface part where Mg is concentrated.

8. The method of producing a copper alloy plate according to claim 7, wherein the thickness of the surface layer part formed by the surface part removal treatment is 5 μm or less.

* * * * *